United States Patent [19]

Mills

[11] 4,410,566

[45] Oct. 18, 1983

[54] METHOD AND APPARATUS FOR THE REMOVAL OF MILDEW AND OTHER STAINS FROM PAPER OR PARCHMENT

[76] Inventor: Brian W. Mills, Cranley Ct., 59 Cranley Rd., Guildford, Surrey, England

[21] Appl. No.: 325,047

[22] Filed: Nov. 25, 1981

[30] Foreign Application Priority Data

Dec. 11, 1980 [GB] United Kingdom ..... 8039693

[51] Int. Cl.[3] ..... B05D 3/00; D06L 3/02; D06L 3/04

[52] U.S. Cl. ..... 427/161; 8/111; 427/444

[58] Field of Search ..... 8/111; 427/444, 161

[56] References Cited

U.S. PATENT DOCUMENTS 3,318,657 5/1967 Wade ..... 8/111

*Primary Examiner*—Michael R. Lusignan

*Attorney, Agent, or Firm*—James E. Nilles

[57] ABSTRACT

A method for the treatment of paper or parchment to remove mildew or other stains therefrom consisting in passing, for a predetermined period of time, ozone over the paper or parchment in a bleaching chamber after said paper or parchment has been thoroughly wetted and subsequently giving it an inhibitory treatment to raise the Ph value that the paper or parchment enjoyed before treatment to a higher value such that it prevents the mildew or stains reappearing.

14 Claims, 13 Drawing Figures

METHOD AND APPARATUS FOR THE REMOVAL OF MILDEW AND OTHER STAINS FROM PAPER OR PARCHMENT

DESCRIPTION

Background of the Invention

This invention relates to a method and to apparatus for the treatment of paper or parchment inter alia water colours and drawings or similar documents to remove mildew and other stains therefrom. It has been proposed to do this by passing ozone over a document that has previously been slightly dampened to expedite the bleaching, but the method is unsatisfactory on at least two essential points, first the stains are wont to reappear after some days and second ozone is now known to be toxic see Miller, King & Burkhardt; *Toxicity of Ozone,* Ozone Chemistry & Technology (1959) p.344. Clearly special precautions have to be taken to inhibit the reappearance of the stains once removed and and to ensure the extraction of the ozone from a substantially closed space in which an operator is working, which extraction plant is expensive since it is now thought that ozone should not exceed 0.1 mg/m$^3$ in the closed atmosphere of said space. Further some control over the volume and concentration of the ozone that is used in such a method is desirable.

I have discovered inter alia that an efficient control of the toxicity hazard may be achieved simply by quick convertion of the ozone to oxygen and I have further discovered an inhibitory treatment.

SUMMARY OF THE INVENTION

According to one aspect of the present invention there is provided a method for the treatment of paper or parchment to remove mildew or other stains therefrom consisting in passing, for a predetermined period of time, ozone over the paper or parchment in a bleaching chamber after said paper or parchment has been thoroughly wetted and subsequently giving it an inhibitory treatment to raise the Ph value that the paper or parchment enjoyed before treatment to a higher value such that it prevents the mildew or stains reappearing.

According to another aspect of the present invention there is provided apparatus for carrying out the method above.

The invention will be more fully understood from the following description given by way of example only with reference to the figures of the accompanying drawing in which.

FIGS. $\mathbf{8_1}$, $\mathbf{8_2}$, $\mathbf{8_3}$ are three sketches of a mesh grid for use with the apparatus.

Figure 9:
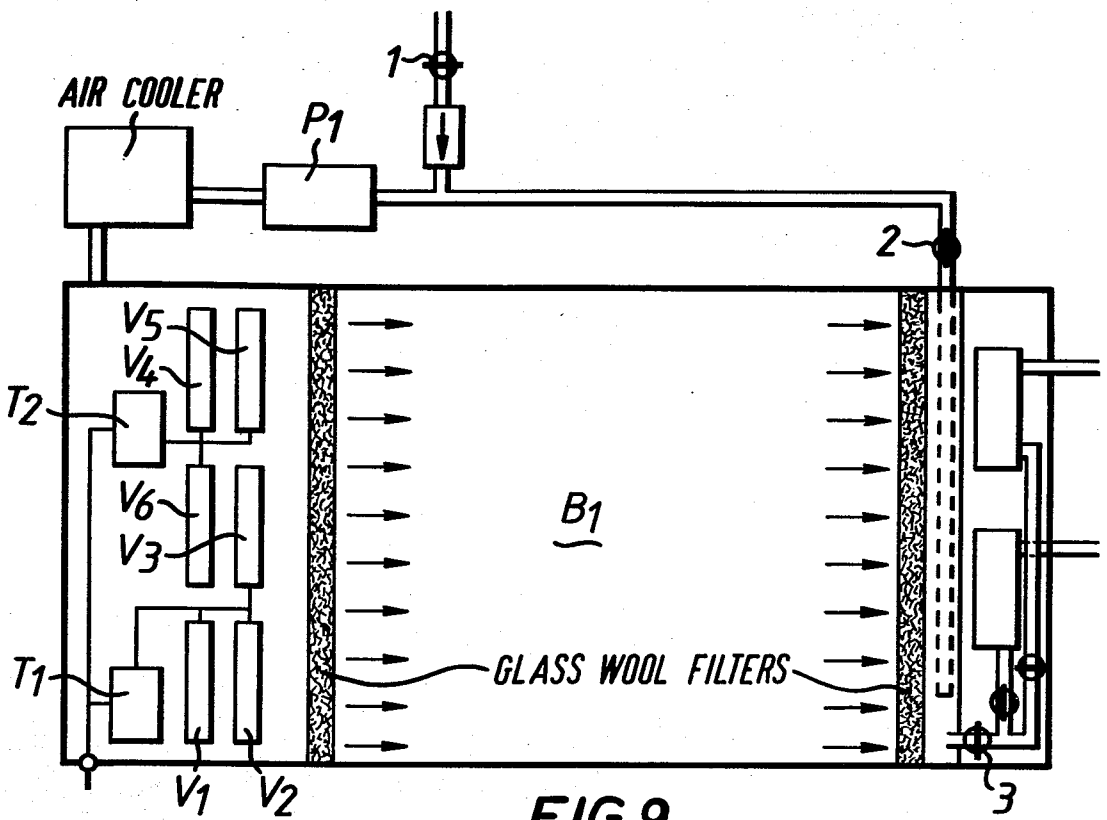

FIG. 9 is a further circuit diagram.

DESCRIPTION OF A PREFERRED EMBODIMENT

Figure 1:
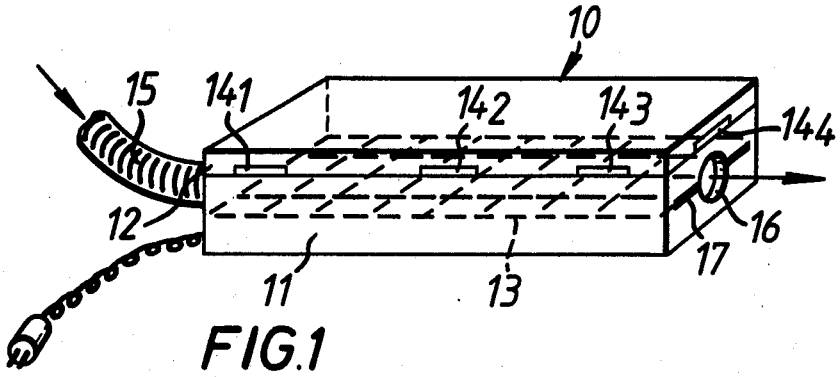
FIG. 1 is a view in parallel perspective of one apparatus of the invention.

Referring now to FIG. 1 a receptacle shown generally at 10 is a flat box 11 with a hinged lid 12 that allows a water colour or a drawing or similar document to be inserted and placed upon a screen 13. The lid is hermetically sealable and when the lid 12 is closed this hermetical seal is indicated to an operator from indicators such as $\mathbf{14_1}$, $\mathbf{14_2}$, $\mathbf{14_3}$, $\mathbf{14_4}$. The receptacle 10 has an ozone inlet at 15 and an ozone outlet at 16. Before the ozone comes out at 16 it has to pass over a heater 17 inside the receptacle. If now the ozone inlet 15 is connected to a supply of ozone the ozone will pass through the box and come into contact with the heater 17 where it will instantaneously be converted to oxygen and escape from the box as an innocuous gas.

Figure 2:
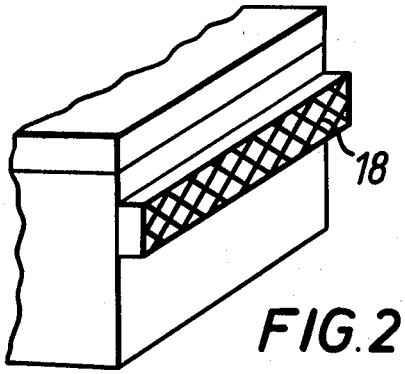
FIG. 2 is a part view of an alternative vent for use with the apparatus of FIG. 1.

In FIG. 2 a combined vent and heater is shown, the wire gauze 18 being electrically heated.

Figure 3:
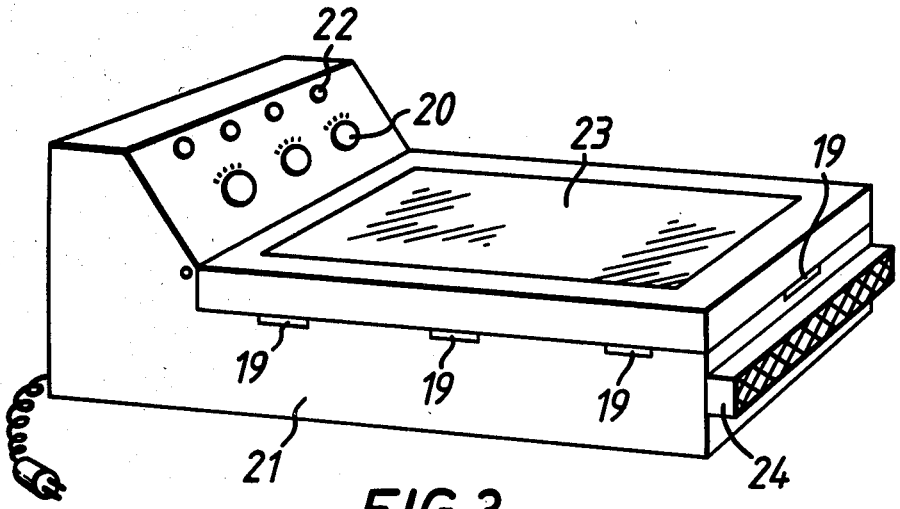
FIG. 3 is a view in parallel perspective of another embodiment of the apparatus of the invention.

In FIG. 3 is shown apparatus having its own ozone generator (not shown) with controls 20 for varying its volume and concentration before it is fed to the drawing or document chamber at 21 which chamber is provided with a hermetical seal (not shown) and indicators at 19 that give readings at 22. The lid has a clear view apparture of glass at 23 and ozone conversion heater at 24.

Any ozone producing plant may readily be coupled to the apparatus of FIG. 3; the ozone plant may be one in which a high electrical potential is discharged between two electrodes through a dielectric, usually glass or mica or employ discharge valves of the totally enclosed, exhausted and neon-filled tube types in which the low potential electrode is an aluminium gauze tightly fitted to the outside of the tube. This gauze permits a generous flow of air in the area of generation to remove the ozone and prevent the build up, in very humid atmospheres, of a moisture film which might otherwise impair the output of the valve. This air flow also allows the rapid dispersion of any heat generated, although it is an advantage that in discharge valves of this type the amount of heat generated is particularly small.

Such an ozone plant is generally fitted with a fan, but a pump is preferred for moving the ozone forward into the receptacle and it is designed to operate from the conventional 220–250 or 110–120 v. 60/60 Hertz single phase electrical supply. Where a fan is used a filter containing gas activated charcoal granules should cover the fan inlet grid to absorb ozone escaping against the direction of air flow due to back pressure or bounce off the fan blades.

It is important that the hermetical seal is properly closed and the heater operating so that no or a very low quantity of ozone is passed out of the receptacle and to this end electrical indicators are deployed. First a clear indication is given to the operator that the lid is hermetically closed by proximity contacts such as $\mathbf{14_1}$, $\mathbf{14_2}$, $\mathbf{14_3}$, $\mathbf{14_4}$ (FIG. 1) connected to the electrical supply to the heater 17 (FIG. 1) which is then brought to the correct temperature for dissociation of ozone to oxygen, which I find to lie in the temperature range of 400° C.–500° C.

Figure 4:
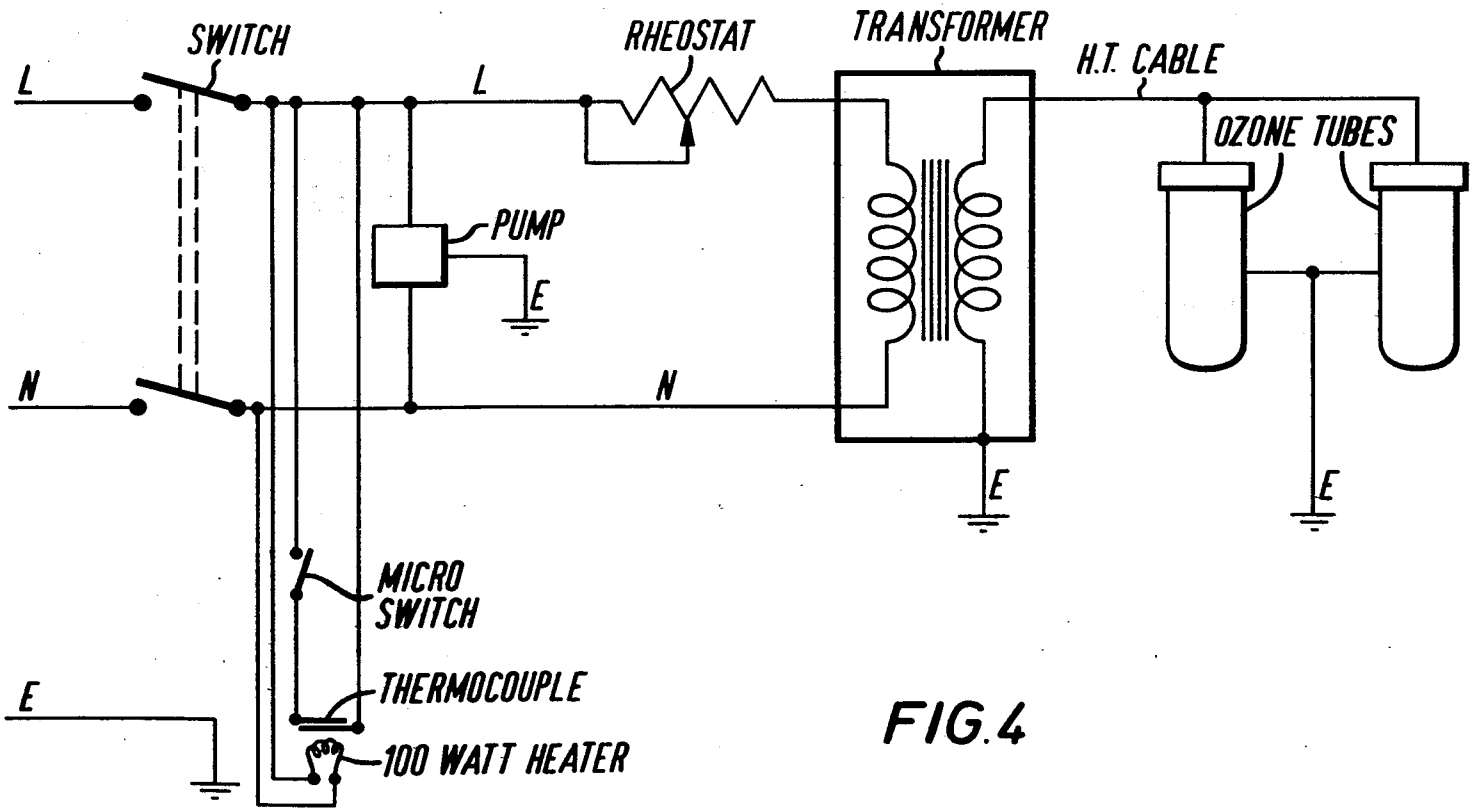
FIG. 4 is a circuit diagram.

One electrical circuit employing a thermocouple co-operating with a heater of 100 watts is shown in FIG. 4, the thermocouple being used to activate the ozone producing plant when the heater is in the said temperature range.

As explained above ozone is a very efficient oxidant but for the practical purposes of removing stains from paper it needs to be very concentrated and in the following system I have used the Wallace & Tiernan Laboratory Ozonator. At a flow rate of 50 liters per hour the ozonator produces ozone at approximately 0.8% concentration by volume in dry air. The alternative of supplying the ozonator with dry oxygen to produce a higher ozone yield has not been used as due to the combustible nature of oxygen this can only be used under controlled laboratory conditions and the system I have designed is for commercial use by art restorers which is so designed to obviate any unnecessary hazards.

For practical purposes the cleaning chamber should be as large as possible to accommodate the various sizes of watercolours and drawings. Clearly to maintain ozone concentration it must be as shallow as possible. I prefer a chamber 41"×31"×2" deep. The base of the chamber being made of ¼" thick translucent white polypropylene with a lighting and reflector system below. The concentration of ozone by volume % is approximately 0.5. In a chamber of these dimensions with the paper of the watercolour or drawing being treated forming a large area obstructing air/ozone circulation a straight inlet and outlet system does not give an even air/ozone flow and leads to lack of uniformity in the bleaching finish. A special design for air/ozone flow has therefore been incorporated.

Secondly, due to the fugitive nature of same watercolour pigments it is desirable to undertake as much of the bleaching process as possible on the reverse of the paper and provision has been made for a special procedure to utilize this principle. All papers should be removed from backing boards where possible as in all standard cleaning procedures.

Slight damping of the paper as taught by Baker in United Kingdom Patent Specification No. 892,602 does not work as the dry air dries out the paper before the ozone has had time effectively to bleach the stains. In contra-distinction a thorough wetting of the paper is necessary to achieve a uniform bleaching of the paper. A special grid and tray has been provided for this purpose.

I have said above that bleached out discolouration nearly always tend to reappear early after the bleaching treatment. It is, therefore, essential that an inhibitory treatment be deployed.

I find that satisfactory results are obtained by washing the paper or parchment in any one of the four following solutions.

(a) Water based 0.3% calcium hydroxide
(b) Water based magnesium bicarbonate 0.7 % magnesium in carbonate solution prepared with $CO_2$.
(c) Spirit based 2% barium hydroxide in methanol.
(d) Spirit based methyl-magnesium carbonate.

To facilitate such an inhibitory treatment I provide a polypropylene tray to take the support grid from the bleaching cleaning chamber.

The paper should be completely dry before the inhibitory treatment is applied thereby to maximize the absorption of the solution when, as is most common, the papers to be treated are acid (Ph 3–5) and the inhibitory treatment is clearly one of de-acidification and the paper is brought as near as possible to neutral (Ph 7).

Another example of apparatus of the invention is shown in FIGS. 5 to 8 of the accompanying drawings.

Figure 5:
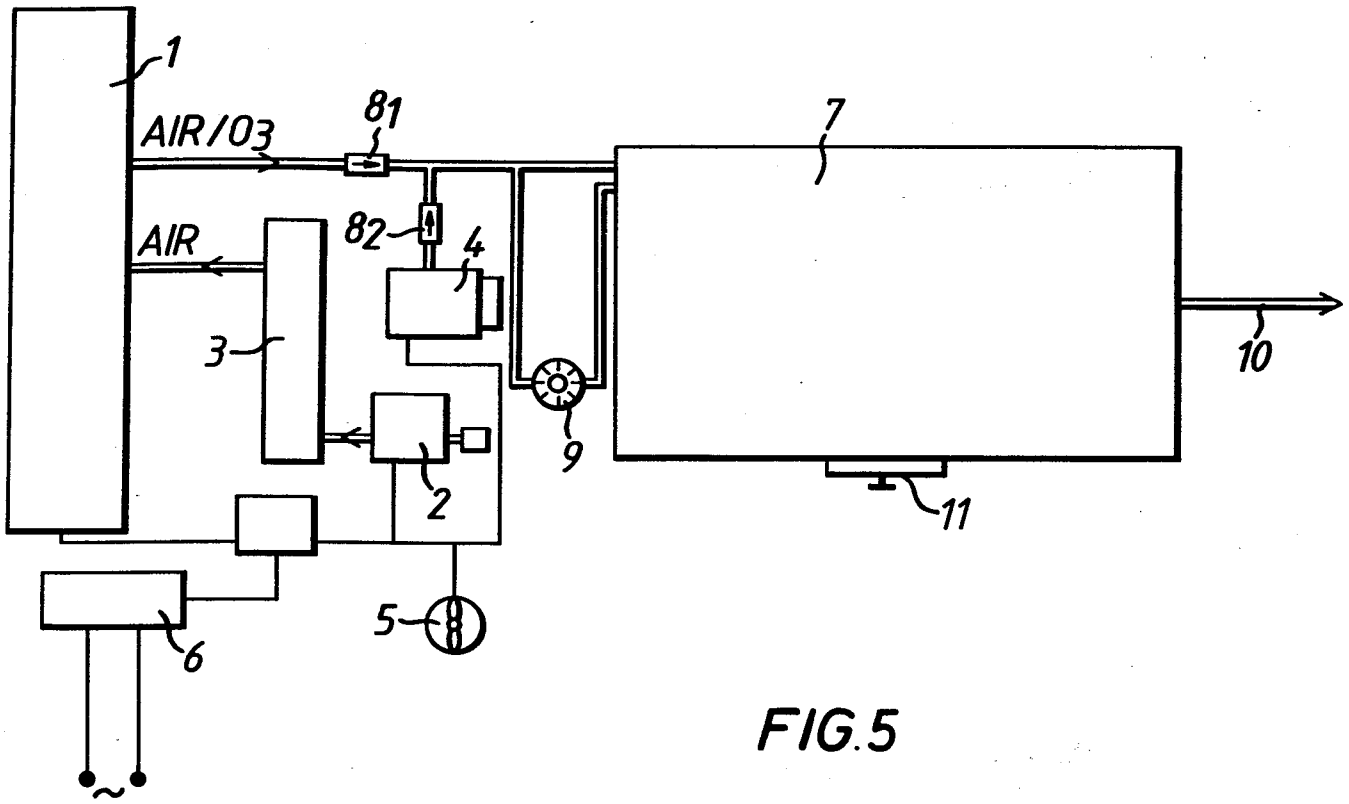
FIG. 5 is another circuit diagram.

In FIG. 5 the basic components are:

1. Laborator Ozonator.
2. Air pump supply 1. above.
3. Air drier containing silica gel or activated alumina.
4. Evacuation pump.
5. Cooling Fan.
6. Safety power switch unit.
7. Cleaning chamber with four 40 watt fluorescent strip lights beneath a translucent base.
$8_1$ $8_2$.Non-return valves.
9. Upper air/ozone control valve.
10. Vent.

The cooling fan 5 is provided so that if the ozonator 1 is used for long periods at a low flow rate of say 50 liters per hour the valves can heat up causing a drop in ozone concentration. There is no danger to this overheating as the ozonator is designed for continuous operation. I have, however, found a low flow rate most efficient and I have incorporated the fan 5 to prevent a fall off in ozone concentration if the unit is used for long periods without a break.

All metal parts of the apparatus are preferably made from 316 stainless steel. The tubing is TYGON or VITON. A see-through top of the chamber is plate glass. All plastic parts in contact with ozone are polypropylene unplasticised P.V.C. or Teflon.

An additional air pump FIG. 5 has been introduced to the system capable of evacuating the chamber in four to five minutes in order that treatment can be stopped as soon as the required level of cleaning has been achieved or if it is suspected that fuller cleaning could result in loss of pigment.

The tubing 10 evacuating the chamber FIG. 5 is of external diameter approximately seven millimeters (0.27 inch) and can be of unplasticised P.V.C. with no restriction on maximum length. It can, therefore, be vented to the outside at considerable distance to the chamber although under these circumstances TYGON or VITON tubing should be used encased in electrical conduit to guard against damage to the tube and possible leakage of high concentration ozone. This small bore evacuation tubing excludes the need of extractor fans and trunking and renders the whole unit completely portable.

As a safety precaution a safety power switch has been incorporated in the system to protect the operator against any possible current leakage to earth.

Watercolours are most difficult to treat owing to the fugitive nature of some of the pigments. As can be seen from FIGS. 6A, 6B the air/ozone flow in the cleaning chamber has been split between an upper and lower level with the intent of reducing the upper flow from between an equal ratio upper to lower flow to a complete lower flow. Although the air/ozone mixture will permeate the whole chamber to some extent with the outlet at the base of the chamber the major flow will be under the paper to be treated when the upper flow is shut off and the upper surface can be masked.

Figure 6A:
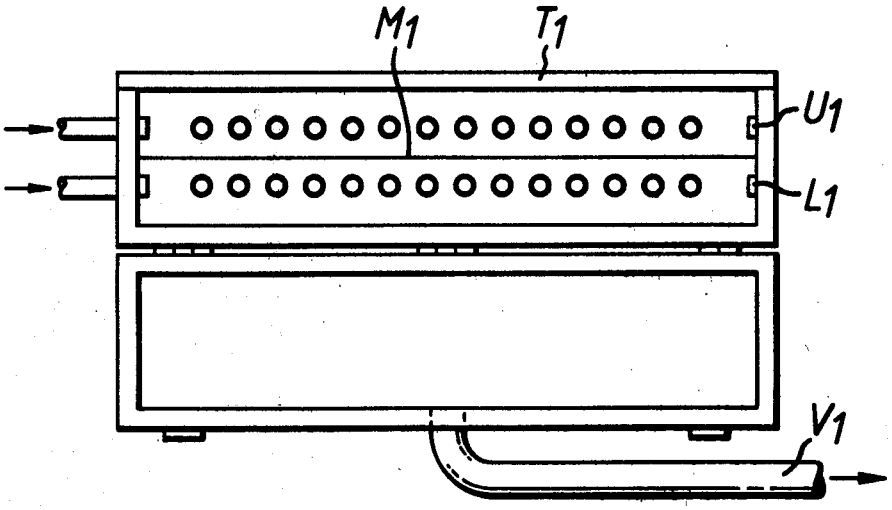
FIGS. 6A, 6B are a side sectional elevation and plan respectively of a bleaching chamber.
Figure 6B:
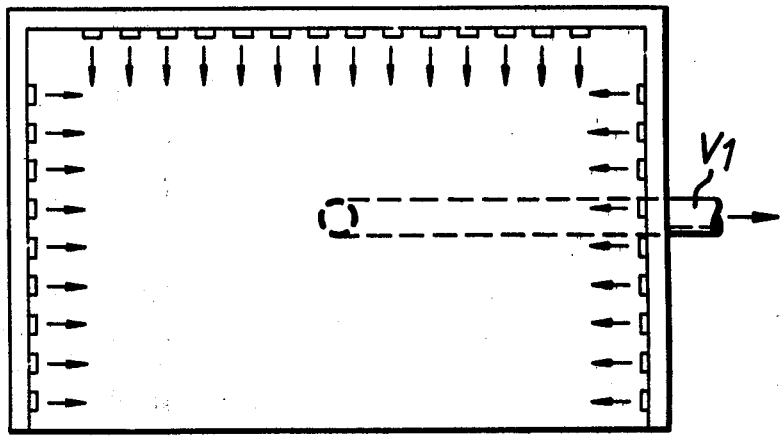

The bleaching chamber is shown in more detail in FIGS. 6A, 6B. It has a plate glass or other oxidant resistant clear view material top plate T1. The two, upper and lower, air/ozone flow nozzles are shown at $U_1$ and $L_1$ respectively and the outside vent at $V_1$. The nozzles $V_1$ $L_1$ give upper and lower air/ozone flow paths with a membrane $M_1$ for the paper or parchment therebetween.

Figure 7A:
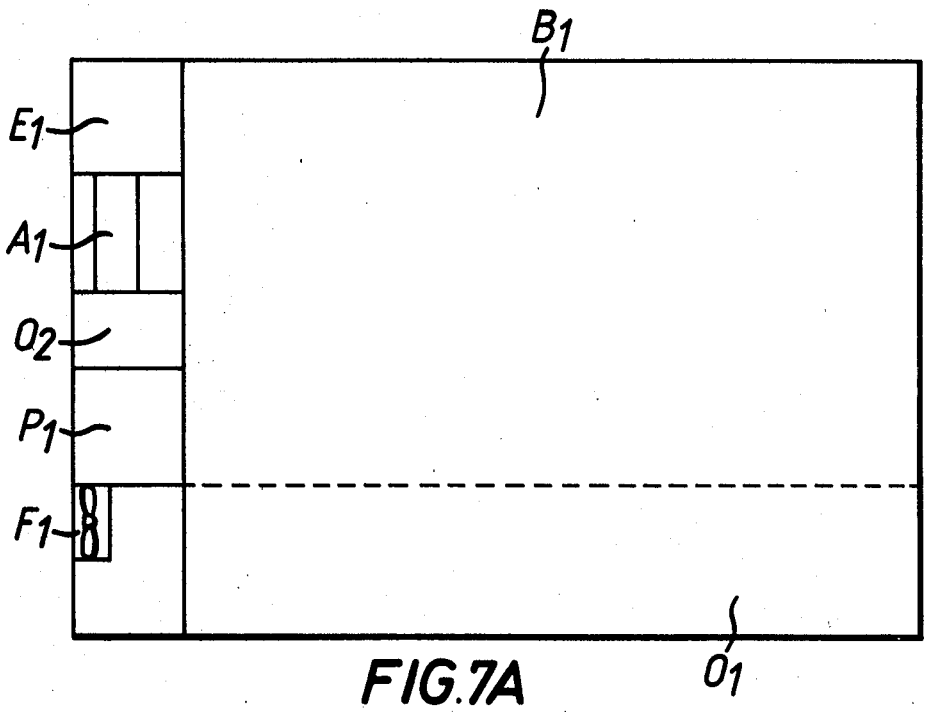
FIGS. 7A, 7B are a top and front elevation respectively of a consolidated unit.
Figure 7B:
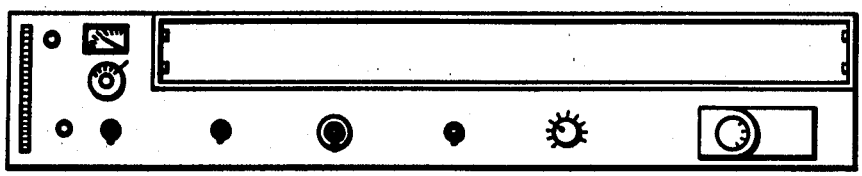
Figure 81:
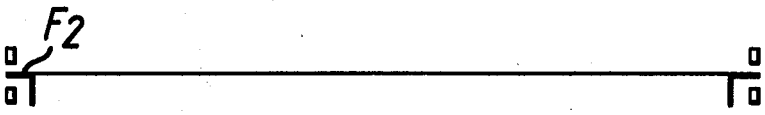
Figure 82:
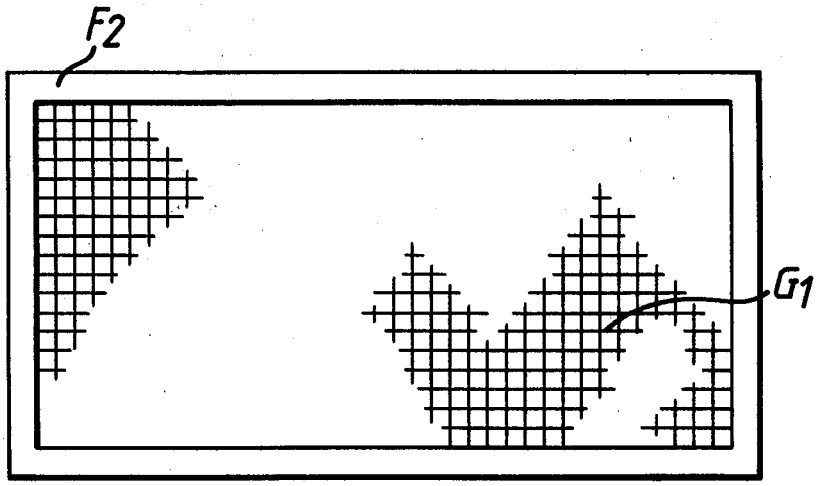
Figure 83:
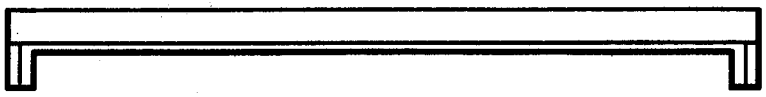

In FIGS. 7A, 7B a consolidated unit includes a bleaching chamber (41"×31") B1, an oxonator $O_1$ a cooling fan $F_1$ a power supply $P_1$ and ozone feed pump $O_2$, an air drier A1 and an evaporator pump $E_1$. The apparatus is only approximately 7" high.

In FIGS. $8_1$, $8_2$ there is shown a high grid coming to the mid height of the bleaching chamber when in use. The grid has an outer frame F2 and space stainless steel wire gauze G1 (½ spacing 316 wire).

A polypropylene tray (42"×32"×2") is shown in FIGS. $8_1$–$8_3$, it has its base raised internally by ¾" to minimise the quantity of liquid required.

In FIG. 9 apparatus is shown having six valves $V_1$–$V_6$ and two transformers $T_1$ $T_2$. This is a completely closed system whereby the exhaust from the bleaching chamber $B_1$ is returned via a pump $P_1$ to the ozone producing portion of the chamber. This results in a very high level of ozone being maintained i.e. approximately 0.25%. However, with a closed system the $O_3$ valves heat up and the ozone concentration rapidly falls, therefore, an electrically operated air cooler is incorporated which eleminates this problem and maintains a consistent $O_3$ concentration. At the end of the process gas tap (1) is opened to allow outside air into the system and the ozone valves switches off. Gas tap (2) is closed and gas tap (3) opened to allow the chamber to exhaust through gas tap (1) containing gas activated charcoal granules. An auxiliary gas tap (2) has been incorporated as a safety factor.

The glass wool fills at either end of the chamber ensure an even spread of air/$O_3$ mixture from one end of the chamber to the other. The flow rate for the system is 100 liters/hour.

The heating system of ozone breakdown was not used on this system as the ozone concentration is such that a very hot element would be required resulting in a high volume of hot air being vented in the room where the system was housed.

One operating procedure is now given by way of example.

i. The watercolour is immersed in water for ten or fifteen minutes using the chamber grid in the polypropylene tray. The method of adding alcohol to water to increase absorption should not be used as ozone can oxidize alcohol to acids and in some cases peracids.

ii. The watercolour is lifted out of the polypropylene tray and allowed to drain for two or three minutes. The face of the watercolour is then covered by a sheet of cellophane or clear unplasticised P.V.C. the same overall size of the grid and the whole then inserted in the chamber, which is then closed. As the protection sheet extends to cover the whole of the gride area, several watercolours may be treated at the same time. In which case the final surface cleaning procedure should be stopped each time one of the watercolours is judged to be sufficiently cleaned and the procedure repeated with each watercolour in turn.

iii. The ozonator supply is then switched at maximum concentration and the upper supply valve turned to off. Cleaning will now begin to take place from the reverse of the watercolour whilst the face is completely protected.

After a period which may be between 30 minutes to two hours the cleaning effect from the reverse will be visible and can be checked by switching in the inspection light, at this stage the ozonator is switched off and the chamber evacuated by switching in the evacuator pump. After 5 minutes the chamber can be opened and the protecting sheet removed from the face of the watercolour and grid. The chamber is again closed and the ozonator switched on with the upper air/ozone supply valve turned to the equal flow position. When the watercolour is seen to be as clean as required the ozonator is again switched off and the evacuation pump switched on. Whenever the evacuation pump is switched on the upper air/ozone flow valve should be in equal flow position. After 5 minutes the watercolour can either be removed from the chamber and left to dry naturally on the grid or it can be left in the chamber with the evacuation pump running which will effect complete drying between 30 minutes and 2 hours depending on the thickness of the paper.

Recent studies have indicated that paper should be wet prior to de-acidification to improve absorption of the solution. However, if this method is preferred with this cleaning system the paper should be allowed to dry after cleaning to allow the breakdown of any residual ozone. The paper can then be re-wetted before de-acidification if preferred.

If, as can be the case, some marks remain after overall cleaning, the watercolour can be retreated with the surface again masked but with small apertures cut to expose the stubborn remaining stains to the air/ozone mixture.

The above procedure is a safety procedure where colours are suspected of being fugitive and is the recommended initial procedure until the operator becomes conversant with the oxidant being used. However, it has been found that the majority of watercolours can be cleaned by wetting and placing in the chamber without surface protection, relying on the balance of air/ozone flow above and below the watercolour to achieve the measure of safety required to protect the pigments. Additionally a further measure of safety control is the voltage regulator determining the ozone concentration. This can be set at minimum and gradually increased as it becomes apparent tha the pigments are not being affected.

Pencil drawings, black and white etchings and engraving can be fully cleaned overall initially, although hand coloured work should be treated in the same way as watercolours.

Water based inks can be problematical and the paper should only be wetted by sponge or brush from the reverse with any surface wetting confined to the stained areas alone. It is therefore advisible to test all ink drawings to determine whether they are spirit or water based and if the latter a small local test should be done to discover if the ink is still water soluble.

After the watercolour has been immersed in the chosen deacidification solution it can either be left to dry naturally or it can be returned to the chamber with the evacuation pump on and the drying time then will be almost identical to the drying time of the paper after cleaning if this method was chosen at the time. If the chamber is used as a drying chamber after de-acidification it should be cleaned after use. If after all normal cleaning treatment one or two stubborn marks remain, as can happen with all cleaning systems spot cleaning with stronger agents can be employed, but the paper must then be thoroughly rinsed before the inhibitory treatment.

The following advantages from the process of the invention are obtained:

a. Residual ozone molecules left in wet paper rapidly break down into oxygen molecules leaving no chemical residue in paper. Therefore prolonged rinsing an neutralisation of residual chemicals as in other cleaning systems is unnecessary.

b. Complete electrical control of oxidant concentration, which combined with masking of surface, minimises risk of damage to watercolour pigments.

c. System virtually portable with small bore evacuation eliminating need for extractor fans and trunking.

d. Only chemicals required are for de-acidification.

e. Bleaching chamber can also be used as a drying chamber quite independently of cleaning process.

f. No long term subjection to irritant chemical baths such as chloramine T or sodium/calcium hypochlorite solutions.

g. The system will work at all normal ambient temperatures and in fact the colder the inlet air temperature the more efficient the ozonator.

h. If under certain circumstances there is no possible way of venting to the atmosphere an absorption tray can be constructed containing gas activated charcoal granules (which can be regenerated by heating in the same way as silica gel crystals) or by venting the air/ozone mixture through a gas washing bottle containing potassium iodide solution. If a gas tap is used it is recommended that an auxiliary tap be used alongside so that if ozone becomes detectable by smell during operation of the system the auxiliary tap can be brought into use without interupting the cleaning cycle. The venting of the chamber would need to be at a slower rate than the normal system and this rate would be determined by the volume of charcoal or potassium iodide used. Tests have shown that the chamber can be evacuated at a rate of 100 liters per hour i.e. 30 minutes through an air drying tower 420 millimeters high and 45 millimeters internal diameter containing 1 kilogram of 10–18 mesh granulated charcoal activated for gas absorption for a minimum of twelve total 30 minute evacuations without ozone being detected at the T.L.V. of 0.1 part per million. No quantative tests have been conducted to potassium iodate by the ozone and cannot be regenerated as with the charcoal.

I claim:

1. A method for the treatment of paper or parchment to remove mildew or other stains therefrom consisting in passing, for a predetermined period of time, ozone over the paper or parchment in a bleaching chamber after said paper or parchment has been thoroughly wetted, and subsequently giving said paper or parchment an inhibitory treatment to raise the pH value of said paper or parchment from that value existing before treatment to a higher value, such that said inhibitory treatment prevents the mildew or stains from reappearing.

2. The method according to claim 1, wherein when the paper or parchment is in the pH range of 3.0 to 5.0 the inhibitory treatment is one of de-acidification which brings the paper or parchment to a neutral pH value of 7.

3. The method according to claim 1 or 2, wherein the inhibitory treatment consists of washing the paper or parchment in water based 0.3% calcium hydroxide.

4. The method according to claim 1 or 2, wherein the inhibitory treatment consists of washing the paper or parchment in water based magnesium bicarbonate comprising 0.07% magnesium in carbonate solution prepared with $CO_2$.

5. The method according to claim 1 or 2, wherein the inhibitory treatment consists of washing the paper or parchment in spirit based 2% barium hydroxide in methanol.

6. The method according to claim 1 or 2, wherein the inhibitory treatment consists of washing the paper or parchment in spirit based methyl-magnesium carbonate.

7. The method of claim 1 or 2 wherein ozone is supplied to the paper or parchment at a flow rate of 50 l/h at 0.08% concentration by a volume of dry air in said bleaching chamber.

8. The method of any one of claims 1 or 2 wherein the ozone flow rate is 100 l/h at 0.25% concentration by a volume of dry air in said bleaching chamber, said method including the use of an air cooler.

9. The method according to claim 7 wherein the bleaching chamber has a rectangular prismatic form having an area large enough to enclose watercolours and of two inches depth.

10. The method according to claim 9 wherein the volume of the chamber is 2540 cubic inches.

11. The method according to claim 8 wherein the bleaching chamber has a rectangular prismatic form having an area large enough to enclose watercolours and of two inches depth.

12. The method according to claim 10 wherein the volume of the chamber is 2540 cubic inches.

13. The method of claim 1 or 2 including the step of drying said paper or parchment between said ozone treatment and said inhibitory treatment.

14. The method of claim 13 including the step of rewetting the dried paper or parchment prior to said inhibitory treatment.

* * * * *